US005365710A

United States Patent [19]

Randjelovic

[11] Patent Number: 5,365,710

[45] Date of Patent: Nov. 22, 1994

[54] RESILIENT SUBFLOOR PAD

[75] Inventor: Erlin A. Randjelovic, Crystal Falls, Mich.

[73] Assignee: Connor/AGA Sports Flooring Corporation, Amasa, Mich.

[21] Appl. No.: 16,903

[22] Filed: Feb. 12, 1993

[51] Int. Cl.[5] ..... E04B 5/52

[52] U.S. Cl. ..... 52/480; 52/403.11

[58] Field of Search ..... 52/480, 403.1

[56] References Cited

U.S. PATENT DOCUMENTS

| | | |
|---|---|---|
| Re. 26,239 | 7/1967 | Rockabrand et al. . |
| 216,656 | 6/1879 | Chase . |
| 498,344 | 5/1893 | Williams . |
| 638,997 | 12/1899 | Stock . |
| 863,054 | 8/1907 | Dickerson . |
| 895,215 | 8/1908 | Vogel . |
| 1,137,138 | 4/1915 | Heron . |
| 1,356,797 | 10/1920 | Stock . |
| 1,356,798 | 10/1920 | Stock . |
| 1,477,331 | 12/1923 | Ely . |
| 1,734,727 | 11/1929 | Herold . |
| 1,757,518 | 5/1930 | Ehmer . |
| 1,789,576 | 1/1931 | Bowman . |
| 2,167,696 | 8/1939 | Tetzman . |
| 2,569,709 | 10/1951 | Elmendorf . |
| 2,823,427 | 2/1958 | Kuhlman . |
| 2,862,255 | 12/1958 | Nelson . |
| 2,893,665 | 7/1959 | Paulsen . |
| 3,107,377 | 10/1963 | Nathan . |
| 3,191,896 | 6/1965 | Nathan . |
| 3,273,296 | 9/1966 | Soulon . |
| 3,288,405 | 11/1966 | Johnson . |
| 3,337,167 | 8/1967 | Johnson . |
| 3,368,806 | 2/1968 | Szonn . |
| 3,417,950 | 12/1968 | Johnson . |
| 3,425,652 | 2/1969 | Leary . |
| 3,436,042 | 4/1969 | Van Goubergen . |
| 3,440,787 | 4/1969 | Bataille . |
| 3,473,281 | 10/1969 | Omholt . |
| 3,499,255 | 3/1970 | Sweeney et al. . |
| 3,601,345 | 8/1971 | Johnson . |
| 3,604,173 | 9/1971 | Dahlberg . |
| 4,002,315 | 1/1977 | Van Goubergen . |
| 4,003,174 | 1/1977 | Kotcharian . |
| 4,301,207 | 11/1981 | Schomerus . |
| 4,302,552 | 11/1981 | Hongu et al. . |
| 4,557,475 | 12/1985 | Donovan . |
| 4,589,243 | 5/1986 | Abendroth . |
| 4,648,592 | 3/1987 | Harinishi . |
| 4,694,627 | 9/1987 | Omholt . |
| 4,860,516 | 8/1989 | Koller . |
| 4,869,479 | 9/1989 | Colonel . |
| 4,879,857 | 11/1989 | Peterson . |
| 4,890,434 | 1/1990 | Niese . |
| 4,930,280 | 6/1990 | Abendroth . |

FOREIGN PATENT DOCUMENTS

| | | |
|---|---|---|
| 1907190 | 8/1970 | Germany . |
| 18671 | 2/1899 | Switzerland . |
| 4073 | of 1888 | United Kingdom . |
| 18992 | of 1909 | United Kingdom . |
| 23589 | of 1914 | United Kingdom . |
| 242924 | 11/1925 | United Kingdom . |
| 466476 | 5/1937 | United Kingdom . |
| 565012 | 10/1958 | United Kingdom . |
| 1226445 | 3/1971 | United Kingdom . |
| 1263731 | 2/1972 | United Kingdom . |

OTHER PUBLICATIONS

*Performance Engineered Wood Flooring Systems*, Brochure by Connor/AGA printed in 1993.

*Primary Examiner*—Carl D. Friedman
*Assistant Examiner*—Beth A. Aubrey
*Attorney, Agent, or Firm*—Merchant, Gould, Smith, Edell, Welter & Schmidt

[57] ABSTRACT

The invention is a resilient pad for placement under a floor system. The pad is made up of a base and a plurality of pad elements spaced longitudinally apart and attached to the base. At least one of the pad elements has a thickness which is greater than another of the pad elements. Because the pad elements have different thicknesses, the resilient pad provides desirable response and shock-absorption characteristics over a wide range of applied loads. Hence, the resilient pad is especially suitable for use with sports floors and the like.

14 Claims, 2 Drawing Sheets

RESILIENT SUBFLOOR PAD

BACKGROUND OF THE INVENTION

The present invention relates generally to resilient pads which are placed under sports floor systems such as gymnasiums, exercise floors, and the like. More particularly, the invention relates to such a pad which is designed to provide desirable response and shock absorption characteristics under a wide variety of floor loads.

It is generally known to provide cushioning pads under a sports flooring system in order to provide resiliency to the floor. In such known systems, the amount of cushioning provided by the pads is generally controlled by the durometer, i.e., the hardness, of the pads. There are both advantages and disadvantages to using either hard or soft pads.

Specifically, in sports such as basketball and racquetball, it is important that the floor be relatively stiff, so that the ball bounces back easily and uniformly throughout the floor. High durometer (hard) resilient pads produce a floor having preferred ball response characteristics. However, such hard pads do not deform easily when the floor is placed over an uneven base substrate. If there is a loss of contact between a particular pad and the base substrate, a "dead spot" will be created, causing very poor ball response at that point. Furthermore, hard pads provide little shock absorption, and have a greater potential to cause harm to the athlete. This problem is especially severe when heavy loading occurs from a number of athletes performing in close proximity to each other.

Low durometer (soft) resilient pads provide greater shock absorption and hence provide a higher level of safety to the athlete. These resilient pads also provide for high deflection under light loads, and hence can conform to uneven base substrates, reducing the problem of "dead spots." However, floors employing such soft pads do not produce desirable ball response characteristics under normal loading conditions, and thus are not highly suitable for sports such as basketball and racquetball. Furthermore, soft pads are prone to "compression set" which is a permanent change in profile after the pad has been subjected to high loads for a long period of time. Such compression set can occur in areas where bleachers, basketball standards, or other gymnasium equipment are likely to be placed for periods of time.

Numerous attempts have been made to design a resilient pad which will produce a flooring system having the desirable characteristics of both hard and soft resilient pads, without the disadvantages of each. One such example is U.S. Pat. No. 4,890,434 to Niese. Niese discloses a pad having a frusto-conical shape with an interior relieved area which increases deflectability.

The resilient pad of Niese, however, has several disadvantages. First, the pad provides only a limited change in the response characteristics as compared to a standard pad. Second, the resiliency of the pad cannot easily be changed, for example, in order to customize the pad to a particular floor system. Third, the pad is relatively expensive to produce, as the pad is complex in shape and must be produced in a mold.

SUMMARY OF THE INVENTION

The present invention includes a resilient pad for placement under a floor system. The pad is made up of a plurality of pad elements spaced longitudinally apart. At least one of the pad elements has a thickness which is greater than another of the pad elements.

Preferably, the pad elements are cylindrical in shape, and are aligned with their longitudinal axes extending generally parallel to each other and to the plane of the floor. The thickness of the pad elements is varied by varying the diameter of the cylinders. The resilient pad also preferably includes a base layer to which the pad elements are attached. In such a case, the resilient pad can be attached to the flooring system via the base layer, for example by stapling.

In the most preferred arrangement, the resilient pad has a first pad element having the greatest diameter centrally disposed on the base layer, two second pad elements of lesser diameter, one located on either side of the first pad element, and two third pad elements of lesser diameter still, one being located on either side of the second pad elements.

The resilient pad of the present invention provides desirable response and shock-absorption characteristics over a wide range of applied loads. The larger-diameter pad element deforms relatively easily under light loads, so that the floor conforms to uneven substrates, preventing dead spots. As the loading is increased, the adjacent pad elements of lesser thickness respond. Hence, if a large load is applied to a small area, such as by a number of athletes concentrated in one place, the other pad elements of lesser thickness provide increased resistance to deformation. Also, with the pad of the present invention, there is no need for an increased number of pads under heavy load areas such as bleachers, basketball goals, etc.

The resilient pads of the present invention are also cheaper and easier to manufacture than previous pads. The pads are preferably made out of natural rubber, PVC, neoprene, polyurethane, nylon, or other resilient material. The material for the resilient pads can be formed in long lengths by extrusion. The resilient pads can then simply be cut to the desired length.

Through performance testing commonly used to evaluate sports flooring systems, the length of the pad elements can also be easily adjusted to conform to the particular floor system involved. For example, the length of the largest pad element is generally preferably such that this pad element alone bears the lightest load on the system, i.e., the weight of the system itself. The next-smaller pad elements are then adjusted to help bear the increased loads from athletes performing on the floor, while the smallest pad elements would help bear the largest loads, such as from a large number of athletes or from heavy equipment.

The invention also includes a flooring system employing the resilient pads described above.

DETAILED DESCRIPTION OF THE PREFERRED EMBODIMENT

Figure 1:
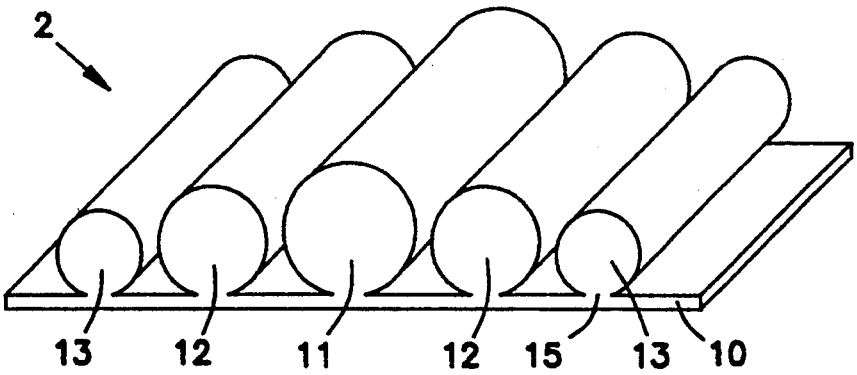
FIG. 1 is a perspective view of the resilient pad of the present invention.

The resilient pad 2 of the preferred embodiment is shown in FIG. 1. As shown therein, the pad is made up of a plurality of pad elements 11–13 connected together by a base 10. The pad elements 11–13 are cylindrical in shape, and are each connected along a narrow strip 15 to the base 10. The pad elements are preferably attached to the base during extrusion of the resilient pad. The strip 15 is preferably kept as narrow as possible so as to allow for deformation of the pad elements around the area of the base 10, as will be hereinafter described.

Figure 2:
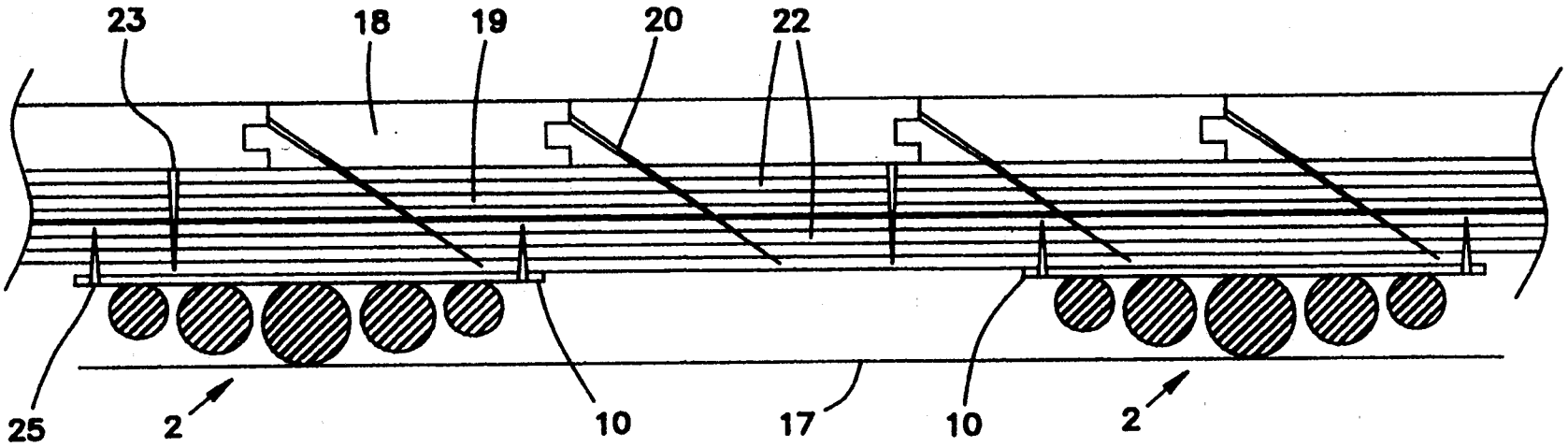
FIG. 2 is a sectional view of a portion of a floor system employing resilient pads of the present invention.

The pad elements are preferably attached such that their longitudinal axes are generally parallel to each other, and are also generally parallel to the floor (see FIG. 2). As shown in FIG. 1, pad element 11 is preferably located generally in the center of the base 10, and has a greater diameter than the other pad elements. Two pad elements 12 are located one on either side of pad element 11, and are of lesser diameter than pad element 11. Two pad elements 13 are located one on either side of pad element 12, and are of lesser diameter than both pad elements 11 and 12.

The pad elements can be made out of a variety of resilient materials, such as natural rubber, PVC, neoprene, nylon, or polyurethane. The pad elements preferably all have the same durometer generally in the range of 40–70, with values of 50 to 60 being most preferred. Base 10 is preferably made out of the same material as the pad elements.

A typical floor system with which the resilient pad of the present invention can be used is shown in FIG. 2. This floor system is made up of flooring 18 attached to a subfloor 19. Flooring 18 is generally made up of hardwood floor strips which are connected together by a tongue and groove arrangement. Subfloor 19 is commonly made up of two layers of plywood 22 connected together by staples 23. Flooring 18 is preferably attached to the subfloor by way of staples or nails 20 driven in above the tongue of the floor strips.

Also shown in FIG. 2 is the substrate 17 over which the flooring system is laid. Substrate 17 is typically a concrete layer or the like.

Two resilient pads 2 made according to the present invention are shown in FIG. 2. The pads are disposed between the subfloor 19 and the substrate 17. The base 10 of the resilient pad is preferably thick enough to provide sufficient durability that the pads can be attached to the underside of subfloor 19 by way of staples 25. The preferred thickness of the base is approximately ⅛ of an inch. Alternatively, the resilient pads may be attached by other means, such as by gluing.

Figure 3:
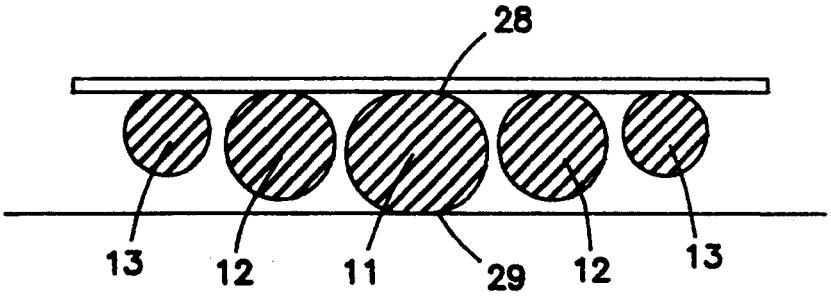
FIG. 3 is a side view of the resilient pad of FIG. 1, shown under light load conditions.

FIG. 3 shows the effect of light loads, such as the weight of the floor system itself, on the resilient pads. As seen in FIG. 3, only the largest pad element 11 compresses under such loading. The compression occurs primarily along the top 28 and bottom 29 of the pad element. The adjacent pad elements 12 and 13 are preferably not compressed at all under such light load conditions.

Figure 4:
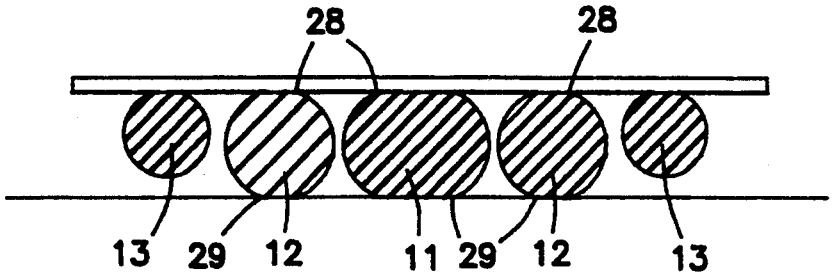
FIG. 4 is a side view of the resilient pad of FIG. 1, shown under moderate load conditions.

FIG. 4 shows the effects of increased loading on the resilient pads. The largest pad element 11 continues to compress, while the next-largest pad elements 12 also begin to bear some of the load and compress. Again, the compression occurs primarily along the top 28 and bottom 29 of the pad elements. The outer pad elements 13 are not yet compressed.

Figure 5:
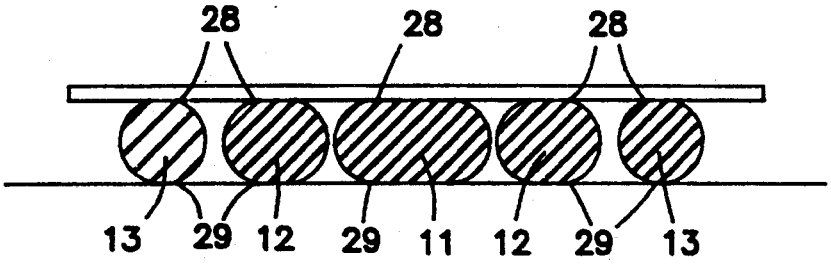
FIG. 5 is a side view of the resilient pad of FIG. 1, shown under heavy load conditions.

FIG. 5 shows the resilient pad under full loading. Such loading would occur when a number of athletes converge on one area of the floor, or when heavy objects, such as bleachers, are placed on the floor. Each of the pad elements is compressed under the heavy load.

The amount of resiliency provided by the pad is directly related to the length of the pad elements 11–13. The optimum length for the pad elements used in a particular flooring system can be determined by performance testing. Because the resilient pad of the present invention has a uniform longitudinal cross-section, the material for the reslient pads can be formed in long lengths by extrusion. The individual resilient pads are then simply cut to the desired length. In a standard system such as the one shown in FIG. 2, the preferred length for the resilient pads is around two inches.

Alternatively, the individual pad elements 11–13 can be extruded separately and then attached to the base 10. As a second alternative, although not preferred because of increased production costs, the resilient pads of the present invention can be formed in a mold. These alternative embodiments allow for variations in the construction of the resilient pad. For example, by these alternative embodiments, the various pad elements can be made of materials having different hardness, if desired.

The number and spacing of the resilient pads in the floor system can also affect the characteristics of the floor system. Again, optimum results can be achieved through performance testing with the particular floor system.

The foregoing constitutes a description of the preferred embodiment of the invention. Numerous modifications are possible without departing from the spirit and scope of the invention. For example, the pad elements need not be circular in cross-section, but can have different cross-sectional shapes. All of the pad elements need not be of the same hardness, nor need they be made of the same material. More or less pad elements than the number shown in the preferred embodiment may be provided, and the pad elements can be provided in more or less than the three different thicknesses as shown. The size and relative dimensions of the various elements can be varied where appropriate. The invention need not be used with the floor system shown in FIG. 2, but can be used with floor systems of various types.

Hence, the scope of the invention should be determined with reference, not to the preferred embodiment, but to the appended claims.

I claim:

1. A resilient pad for placement under a flooring system having a floor surface, said pad comprising a plurality of pad elements each having a longitudinal axis and a thickness, said pad elements being oriented so that their longitudinal axes extend substantially parallel to the floor surface, said plurality of pad elements comprising a first pad element having a first thickness, and at least one second pad element having a second thickness, said second thickness being less than said first thickness.

2. The resilient pad as claimed in claim 1, wherein said pad elements are connected together by a base layer, said base layer being attached to an underside of said flooring system.

3. The resilient pad as claimed in claim 1, wherein said plurality of pad elements comprises two of said second pad elements, said two second pad elements being disposed on opposing sides of said first pad element.

4. The resilient pad as claimed in claim 3, wherein said plurality of pad elements further comprises at least one third pad element having a third thickness, said third thickness being less than said second thickness.

5. The resilient pad as claimed in claim 4, wherein said plurality of pad elements comprises two of said third pad elements, said two third pad elements being disposed on opposing sides of said second pad elements.

6. The resilient pad as claimed in claim 1, wherein each of said pad elements is cylindrical in shape, and wherein said at least one of said pad elements is of greater diameter than said another of said pad elements.

7. A floor system for placement over a substrate, comprising:

(a) a subfloor having a top surface and a bottom surface;

(b) flooring attached to the top surface of said subfloor, said flooring defining a floor surface; and (c) a plurality of resilient pads disposed between the substrate and the bottom surface of said subfloor, wherein each of said pad elements has a longitudinal axis extending generally parallel to each other and to said floor surface, each of said resilient pads comprising a plurality of pad elements spaced longitudinally apart, at least one of said pad elements having a greater thickness than another of said pad elements.

8. The floor system as claimed in claim 7, wherein said pad elements are connected together by a base layer, said base layer being attached to bottom surface of said subfloor.

9. The floor system as claimed in claim 7, wherein each of said pad elements is cylindrical in shape, and wherein said at least one of said pad elements is of greater diameter than said another of said pad elements.

10. The floor system as claimed in claim 9, wherein said plurality of pad elements comprises:

(a) a first pad element having a first diameter;

(b) at least two second pad elements having a second diameter which is less than said first diameter, said second pad elements being disposed on opposing sides of said first pad element; and (c) at least two third pad elements having a third diameter which is less than said second diameter, said third pad elements being disposed on opposing sides of said second pad elements.

11. A floor system for placement over a substrate, comprising:

(a) a subfloor having a top surface and a bottom surface;

(b) flooring attached to the top surface of said subfloor; and (c) a plurality of resilient pads disposed between the substrate and the bottom surface of said subfloor, each of said resilient pads comprising a plurality of pad elements spaced longitudinally apart, at least one of said pad elements having a greater thickness than another of said pad elements, wherein said plurality of pad elements comprises:

(i) a first pad element having a first diameter;

(ii) at least two second pad elements having a second diameter which is less than said first diameter, said second pad elements being disposed on opposing sides of said first pad element; and (iii) at least two third pad elements having a third diameter which is less than said second diameter, said third pad elements being disposed on opposing sides of said second pad elements.

12. The floor system as claimed in claim 11, wherein said pad elements are connected together by a base layer, said base layer being attached to the bottom surface of said subfloor.

13. The floor system as claimed in claim 11, wherein each of said pad elements is cylindrical in shape.

14. The floor system as claimed in claim 13, wherein said flooring defines a floor surface, and wherein each of said pad elements has a longitudinal axis extending generally parallel to each other and to said floor surface.

* * * * *